US005989647A

United States Patent [19]

Remy et al.

[11] Patent Number: 5,989,647

[45] Date of Patent: Nov. 23, 1999

[54] HEAT-TREATMENT DEVICE AND PROCESS

[75] Inventors: Francis Remy, Franconville; Bernard Hansz, Nommay; Vincent Gourlaouen, Houille; Christian Coddet, Giromagny; François Pesme, Levallois-Perret; Han Lin Liao, Cravanche, all of France

[73] Assignee: L'Air Liquide, Societe Anonyme Pour l'Etude et l'Exploitation des Procedes Georges Claude, Paris Cedex, France

[21] Appl. No.: 09/060,463

[22] Filed: Apr. 15, 1998

[30] Foreign Application Priority Data

Apr. 28, 1997 [FR] France ..... 97 05230

[51] Int. Cl.[6] ..... C23C 4/18; B05B 7/16

[52] U.S. Cl. ..... 427/446; 239/79; 239/132.5; 239/290; 239/291; 219/76.14; 219/76.16; 219/121.49; 118/302; 427/398.1; 427/398.3; 427/398.4

[58] Field of Search ..... 239/132.5, 290, 239/291, 105, 79; 219/121.47, 121.55, 121.49, 76.14, 76.16; 118/302; 427/446, 398.1, 398.3, 398.4

[56] References Cited

U.S. PATENT DOCUMENTS

| | | | |
|---|---|---|---|
| 4,141,224 | 2/1979 | Alger et al. | 62/514 R |
| 4,505,945 | 3/1985 | Dubust et al. | 427/8 |
| 4,675,205 | 6/1987 | Boncoeur et al. | 219/76.16 |
| 5,250,780 | 10/1993 | Hansz et al. | 219/121.49 |

FOREIGN PATENT DOCUMENTS

| | | |
|---|---|---|
| 0 124 432 | 11/1984 | European Pat. Off. . |
| 0 546 359 | 6/1993 | European Pat. Off. . |
| 2 347 111 | 4/1977 | France . |
| 1 452 062 | 10/1976 | United Kingdom . |

*Primary Examiner*—Katherine A. Bareford
*Attorney, Agent, or Firm*—Young & Thompson

[57] ABSTRACT

Heat-treatment device which includes a cooling unit comprising delivery nozzles which deliver at least one coolant, characterized in that it furthermore comprises a shielding element designed so as to maintain a gaseous shielding atmosphere around at least part of the delivery nozzles.

12 Claims, 4 Drawing Sheets

HEAT-TREATMENT DEVICE AND PROCESS

FIELD OF THE INVENTION

The present invention relates especially to a device and to a process for a heat treatment of a material and, more particularly, to a device and to a process for coating a surface using a thermal spraying method with cooling.

BACKGROUND OF THE INVENTION

Within the context of the invention, heat treatment should be understood to mean any technique for the treatment of a substrate material which involves cooling at least part of the said substrate material, especially: surface coating, tempering, nitriding, carburizing, plasma spraying, oxycutting, laser cutting, HVOF (high-velocity oxyfuel) spraying, flame spraying, etc. These various heat-treatment techniques are known and widely used in the industrial field.

For example, in order to produce coatings on materials, a spray jet, consisting of hot carrier gas and of molten or softened particles of the coating material, is directed onto the surface of the material or substrate material to be treated, which surface is cooled before and/or after treatment by a jet of a coolant, such as carbon dioxide ($CO_2$) or liquid argon (as shown in FIG. 5).

Thus, plasma spraying is widely used to produce coatings on any type of material, such as composites, for example resins or plastics, which have to be coated with thin ceramic layers or metal layers.

This technique is also used for producing shielding coatings in the mechanical engineering field, for example in the aeronautics or automobile industries, or in the energy industry.

The technique of thermal spraying involves very high temperatures and high heating powers. This is because the spray jet, generally composed of a hot carrier gas and of particles of the coating material, must be at a temperature high enough to make it possible to soften or melt the particles of added coating material and, moreover, to achieve effective heat treatment of the surface of the material or of the component that is to be coated.

The material that is to be coated, or substrate material, therefore heats up considerably because, on the one hand, of the amount of heat provided directly by the hot gases and because, on the other hand, of the at least partially molten coating particles which, when they come into contact with the substrate material, transfer a large amount of heat to the latter in a very short space of time. Conventionally, the substrate material heats up several hundreds of degrees and a thermal equilibrium is established, on the one hand, by heat exchange with the ambient atmosphere and, on the other hand, by diffusion of the heat through the substrate material and through the coating layer.

It has been observed that the adhesion, that is to say the bonding of the coating layer to the substrate material, increases with temperature. In other words, the higher the temperature, the more the mechanical anchoring and the chemical reactions, which are established between the coating layer and the substrate material, change in a favourable way and, consequently, result in more effective rapid cooling.

This may be explained in particular by better wettability of the molten coating particles and therefore better spreading or flattening of the latter on the substrate material.

However, it is also necessary to consider the microscopic properties not only of the coating layer but also of the substrate material.

This is because, when successively stacking several coating layers or laminations, internal tensile stresses are generated in the coating, these stresses being higher the lower the thermal conductivity of the coating material deposited or the thicker the material deposited at each pass.

Such a phenomenon has, in particular, been observed when ceramic-type particles are sprayed, where the appearance of cracks or even, in some cases, delamination of the coating, due to too high a temperature difference between, on the one hand, the substrate material and the coating layer and, on the other hand, in the actual ceramic coating layer, have been observed.

Likewise, during cooling, if the difference in thermal expansion coefficient ($\alpha$) between the substrate material and the coating material becomes too great, residual stresses are generated at the interface between the substrate material and the coating material, which stresses are the cause of disbandment and delamination phenomena.

This has been observed, in particular, when spraying a material of the ceramic type onto metals, such as aluminum, where it has been observed that the ceramic layer ($\alpha=8\times10^{-6}$ $K^{-1}$) cannot adhere to a component made of aluminum ($\alpha=22\times10^{-6}$ $K^{-1}$) if the temperature of the substrate exceeds a few hundred degrees.

From this it follows that the thickness of the coating cannot, in some cases, exceed a few tenths of a millimeter, thereby greatly limiting the possible industrial applications.

This is because, when the coating layer is intended to act as a thermal barrier, i.e. as a thermal insulator, it must, in some cases, have a thickness well above one millimeter, something which is, consequently, not achievable.

It should therefore be understood that the properties of the substrate material to be coated should also be taken into consideration, in particular the thermal expansion coefficient and the thermal conductivity, the latter reflecting the ability of the material to remove heat.

In order to help to solve the aforementioned problems, it is common practice to combine the operation of heat-treating the material, such as the deposition of a coating layer, with an operation of cooling the substrate material before and/or after treating the latter, i.e., for example, spraying the jet comprising the hot carrier gas and the at least partially molten particles of coating material onto the surface of the substrate material.

The use of additional cooling makes it possible, furthermore, to apply the thermal spraying technique to the coating of so-called "sensitive" substrate materials, on which the temperature may have an undesirable effect, such as organic materials or composites, paper or wood, or low-melting-point metals, such as aluminum or copper.

In other words, one of the aims of the additional cooling is to make it possible, by quenching, for heat to be removed effectively and, in all cases, more rapidly than by leaving the component to be treated to cool down by itself, away from the jet of hot gas.

Furthermore, additional cooling makes it possible to establish a much lower temperature gradient between the coating layer and the substrate material, thereby greatly improving the integrity of the coating.

Moreover, using effective cooling also enables the spraying time, and therefore the costs, to be considerably reduced, given that it is no longer necessary to wait until the treated components cool down by themselves; it has been possible, in some cases, to reduce the spraying time by a factor of 10.

Currently, there are several cooling techniques using coolants of different types, according to the effectiveness of the desired cooling, which effectiveness, as we saw above, depends on the intrinsic properties of the substrate material/coating layer pair.

However, care should be taken, in all cases, to ensure that the jet of cooling air disturbs the hot gas as little as possible, i.e. the mixture consisting of one or more hot gases and, in general, molten or softened particles, so as to avoid cooling the jet, oxidizing the molten coating particles, contaminating the coating layer, etc.

However, as we saw previously, the temperature of the substrate material is a critical parameter given that, if its temperature exceeds a certain value, the substrate material may undergo irreversible degradation.

Thus, when it is desired to produce less intensive cooling, that is to say the component to be treated being left at a temperature lying within the range from 150° C. to about 600° C., which is, moreover, easy to implement and inexpensive, it is possible to use compressed air as the coolant.

On the other hand, compressed air is not suitable if it is desired to have good cooling effectiveness.

One alternative therefore consists in using a coolant such as argon or carbon dioxide ($CO_2$) as the coolant.

This is because liquid argon used as the coolant makes it possible to maintain the temperature of the substrate material and/or of the coating layer at a temperature generally between 0 and 150° C., this temperature essentially depending on the pressure of liquid argon and the flow rate of gaseous argon employed, which conditions ensure that the stream of liquid argon is atomized into fine droplets of variable diameter. Such cooling effectiveness allows a very thick coating layer to be deposited, for example a layer about 3 mm thick.

However, the use of liquid argon as the coolant increases the production costs and requires more expensive equipment. Thus, the use on an industrial scale of argon, as the coolant, is generally limited to the heat treatment of components with a high added value.

Apart from argon, it is also possible to use carbon dioxide as the coolant.

The use of $CO_2$ is highly advantageous since, on the one hand, it performs in a similar way to argon, given that the temperature of the substrate material may be maintained at values of about the ambient temperature and, on the other hand, it costs markedly less than argon. Such $CO_2$ cooling can therefore be applied to the heat treatment of all kinds of components, whatever their added value. By way of example, mention may be made of depositing a silica, titanium dioxide or molybdenum coating layer, with a thickness of 1 to 1.5 mm, on a steel component, or else depositing an approximately 3 mm layer of zirconia, which is to act as a thermal barrier, on a component made of an aluminum alloy.

Furthermore, $CO_2$ cooling is also well suited to depositing thin coatings on substrate materials having a high expansion coefficient, such as aluminum alloys. By quenching in a cryogenic liquid, it is then possible to separate the coating from the substrate material.

Likewise, when using an HVOF-spraying heat-treatment process, $CO_2$ cooling allows, in particular, deposition of a tungsten/cobalt carbide coating layer on a substrate material while preventing the formation of a carbide prejudicial to the desired properties, namely, in particular, the wear resistance.

This $CO_2$ cooling also allows deposition of a chromium/nickel layer on aluminum components, something which cannot be carried out using compressed air, given that the difference in expansion coefficient between the chromium/nickel coating layer and the aluminum component demands keeping the temperature below 80° C.

Furthermore, the use of $CO_2$ cooling also prevents copper from becoming highly oxidized when the latter is used as a coating material for producing a thick coating layer, i.e. about 2 mm.

In some cases, it is also possible to use liquid nitrogen as the coolant.

Many thermal-spraying surface treatment processes and devices have already been described in the prior art and mention may be made, by way of example, of the documents: EP-A-0,124,432, U.S. Pat. No. 3,744,262, FR-A-2,347,111, EP-A-0,546,359, or else Research Disclosure, January 1997, p. 30, No. 39329.

These various processes or devices are very similar to each other. Schematically, a coolant, generally liquid carbon dioxide, is applied to delivery means which deliver the coolant, generally one or more nozzles within which the liquid carbon dioxide undergoes expansion and creates a two-phase mixture consisting of carbon dioxide gas and dry ice.

In order to obtain a laminar jet, the nozzle is generally in the form of a tube of well-defined geometry: size, shape, etc.

Sometimes, instead of using carbon dioxide in the liquid state, the use of carbon dioxide in the gaseous state only has been described. However, this requires, on the one hand, the use of high pressures, i.e. at least 45 bar, and, on the other hand, the availability of a heating system which allows the storage temperature of the carbon dioxide to be preferably maintained above 30° C. In this case, the expansion of the gaseous carbon dioxide into a mixture of gas and dry ice is carried out through a nozzle, the end of which has at least a flattened shape.

Although the use of cooling by means of a coolant such as $CO_2$ in a heat-treatment process has a number of advantages, care should nevertheless be taken to ensure that:

- the coolant jet emanating from the nozzles comes into intimate contact with the substrate material;
- the flow rate and shape of the coolant jet are stable and uniform over time, so as to avoid pulsing, i.e. delivery in spurts, one of the causes of which is the condensation of atmospheric water vapour on the nozzles;
- any disturbance of the jet essentially consisting of hot gas and, depending on the case, of molten particles, brought about by the coolant jet is minimal;
- the various flow rates are tailored depending on the position of the nozzles delivering the coolant with respect to that of the thermal-spraying guns or nozzles; and
- the somewhat flattened or somewhat cylindrical shape of the nozzle delivering the coolant is tailored to the case in question.

However, there are still a number of problems arising in this field, problems which hitherto have not been solved.

Among these, the most important is that of the condensation of water vapour, present in the atmospheric air, which occurs on the nozzle or nozzles delivering the liquid coolant and which causes them to ice up.

Such icing of the nozzles is highly harmful since it generally causes formation of a plug which makes the jet of coolant, such as $CO_2$, unstable and turbulent, thereby resulting, on the one hand, in incorrect and not very effective cooling of the substrate material and/or of the coating layer and, on the other hand, in possible prejudicial disturbance of the heat-shield jet.

Currently, any ice formed by the condensation of water vapour in the atmosphere is removed, very briefly, for example by taking the ice-covered nozzle close to an external heat source, which involves stopping the production line and therefore results in a waste of time and a loss of productivity, and hence in an unacceptable increase in the production costs.

SUMMARY OF THE INVENTION

The object of the present invention is therefore to solve this problem of the nozzles delivering a coolant, such as $CO_2$, icing and therefore, consequently, improving the existing heat-treatment devices and processes, by preventing the condensation of ambient moisture at the exit, i.e. at the delivery end, of the nozzle where the coolant expands into a gas/solid mixture, thereby cooling the nozzle and promoting the condensation of the ambient moisture.

The present invention therefore relates to a heat-treatment device which includes cooling means comprising delivery means which deliver at least one coolant, characterized in that it furthermore comprises a shielding means designed so as to maintain a gaseous shielding atmosphere around at least part of the said delivery means.

Preferably, the shielding means are connected to means for supplying at least one gaseous shielding stream.

More particularly, the invention relates to a device which includes:

spraying means which deliver at least one jet containing at least one hot carrier gas, and cooling means comprising delivery means which deliver at least one coolant, characterized in that it furthermore comprises shielding means connected to means for supplying at least one gaseous shielding stream, the said shielding means being designed so as to maintain a gaseous shielding atmosphere around at least part of the said delivery means.

Depending on the case, the device may furthermore comprise one or more of the following characteristics:

the delivery means are one or more delivery nozzles;

the shielding means include a sleeve which surrounds, at least partially, the delivery nozzle or nozzles;

the sleeve is fastened at a proximal end to the delivery means, preferably, upstream of the nozzle;

the sleeve has a free distal end, preferably having a restriction;

the sleeve has a distal end partially closed off by a closing-off means;

the sleeve includes at least one orifice through which the gaseous shielding stream conveyed by the supply means is introduced;

the delivery nozzle includes an end having a circular or oval cross-section or having a flattened cross-section.

The present invention also relates to a heat-treatment process in which a material is treated by means of a device according to the invention; preferably, the heat treatment is a surface coating, i.e. the application of one or more layers of one or more coating materials on at least part of the surface of a substrate material or of a component.

The invention furthermore relates to a process for the heat treatment of a material, in which:

at least part of the surface of the material is sprayed from at least one jet containing at least one hot carrier gas;

at least part of the material is cooled by means of at least one delivery nozzle which delivers a coolant; and at least part of the delivery nozzle is maintained under a gaseous shielding atmosphere by means of at least one shielding gas.

Depending on the case, the process may furthermore comprise one or more of the following characteristics:

the delivery nozzle is maintained under a gaseous shielding atmosphere by flushing the nozzle with the gaseous shielding stream.

This gaseous shielding stream may, for example, be generated by the $CO_2$ serving for cooling, by using, at the nozzle exit, a system which makes it possible to maintain, by a partial vacuum, a gaseous shielding atmosphere around the cooling nozzle, which atmosphere consists of gaseous $CO_2$ obtained by expansion of the coolant;

the hot spray jet furthermore includes particles of an at least partially molten material, or softened particles, i.e. in a "pasty" form, and, preferably, of a material selected from the group formed by metals, metal alloys, ceramics, plastics or polymers, silica and metal oxides;

the coolant is selected from nitrogen, carbon dioxide, argon and mixtures thereof;

the flushing is performed by means of at least one dry gas, preferably a gas selected from the group formed by dry air, nitrogen, helium, argon and mixtures thereof. In general, the gases or gas mixtures are also suitable for making it possible to modify the wettability of the molten particles or the cooling with respect to the substrate material;

the gaseous shielding atmosphere, in the sleeve, is at a pressure of greater than $0.9\times10^5$ Pa, preferably greater than or equal to $10^5$ Pa, advantageously within the range $1.1\times10^5$ Pa to $3\times10^5$ Pa and more advantageously within the range $1.1\times10^5$ Pa to $2\times10^5$ Pa; and the flow rate of the gaseous shielding stream depends on the geometry, in particular on the diameter, of the nozzle. Thus, the flow rate of the shielding stream preferably lies within the 5 l/min to 30 l/min range for a nozzle having a diameter of 0.5 mm to 30 mm and within the 8 l/min to 25 l/min range for a nozzle having a diameter of 1 mm to 10 mm.

Preferably, the process according to the invention is a surface coating process.

The invention furthermore relates to a shielding sleeve capable of being used for carrying out a heat-treatment process.

The device and the process according to the invention may be used in a process for manufacturing a component made of a material selected from metals, metal alloys, polymers or plastics, organic materials and inorganic materials, for example a component of a combustion chamber or a medical prosthesis.

The invention also relates to a component capable of being manufactured by a process involving at least one heat-treatment step by means of a device or of a process according to the invention.

As emerges from the foregoing, the Applicant has demonstrated, surprisingly, that it was possible to eliminate the presence of residual atmospheric moisture around the exit of the nozzle, and therefore the condensation of the moisture in contact with the nozzle, by shielding that part of the nozzle where this condensation occurs, by using a gaseous shield, the flow rate and pressure of which are adapted in order to prevent the ambient air from coming into contact with the cold part of the nozzle.

Although in the present case the gaseous shield consists of nitrogen or of dry air, any gas or gas mixture having a dew point sufficiently low not to cause icing is capable of being used as such.

The present invention may be applied in all fields where cooling by means of a coolant such as $CO_2$ is necessary.

BRIEF DESCRIPTION OF THE DRAWINGS

The invention will now be described in greater detail by means of embodiments given by way of illustration, but implying no limitation, with reference to the appended figures in which.

DETAILED DESCRIPTION OF THE INVENTION

The cooling nozzles which can be used in a heat-treatment process and are depicted in FIGS. 1 to 4 are nozzles readily available commercially, that can be obtained from companies specializing in the marketing of this type of product, such as the companies Agefko or Spraying System.

Figure 1:
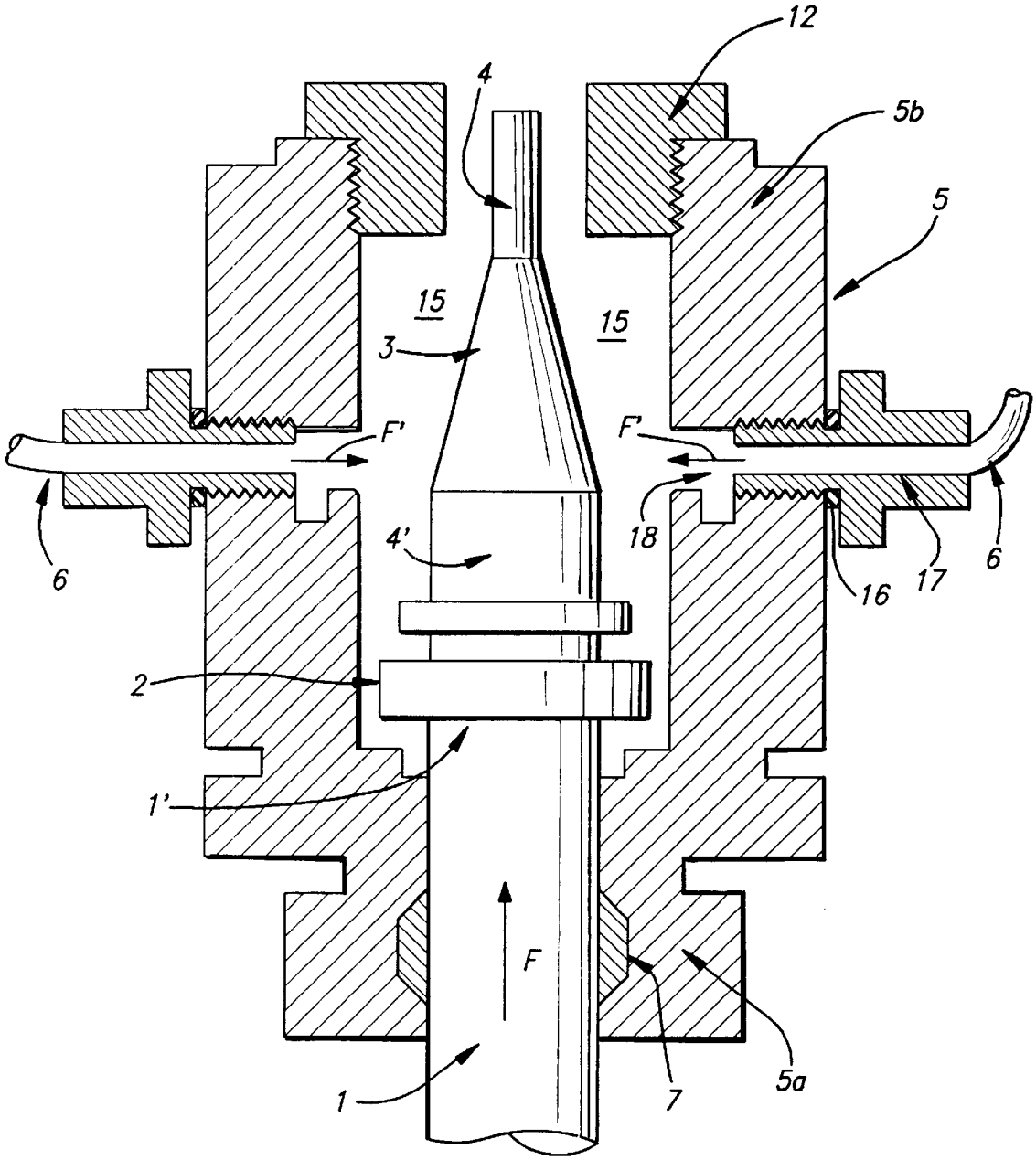
FIG. 1 depicts, diagrammatically, a longitudinal sectional view of a first embodiment of a device according to the invention.

Depicted in FIG. 1 is a nozzle 3 for delivering carbon dioxide (liquid $CO_2$) conveyed from a liquid-$CO_2$ storage place, not shown, to the nozzle 3 by means of, in particular, a hollow tube or pipe 1 in the direction depicted by the arrow F.

The nozzle 3 has a downstream part or end 4, the cross-section of which has an approximately cylindrical or oval shape, and an upstream part or end 4' connected to the downstream end 1' of the pipe 1 by connection means 2, for example screwing-type connection means.

In order to prevent the nozzle 3 from icing by the ambient moisture depositing on this nozzle 3 where the expansion of the liquid $CO_2$ takes place, an axisymmetric component 5 having approximately the shape of a sleeve is provided around the nozzle 3; this sleeve 5 has been partially depicted (longitudinal section) in FIG. 1.

More specifically, this sleeve 5, formed from one or more parts, is fastened at its proximal end 5a by fastening means 7 to the body of the tube 1 near its end 1' and upstream of the latter.

Preferably, the fastening means 7 are also used to provide a gastight seal, preventing any undesirable ingress of the atmospheric air into the connection between the proximal end 5*a* and the tube 1.

The other end of the sleeve 5, or distal end 5*b*, is free and includes a piece or part 12 going towards the end 4 of the nozzle 3 and making it possible to sheathe the end 4 of the nozzle 3 with the shielding gas, thereby preventing the ambient moisture from being deposited on the nozzle and causing icing thereon.

The piece 12 may be a separate piece which is fixed to the end 5*b*, for example by screwing, or may form an integral part of the end 5*b*, that is to say that the end 5*b* and the piece 12 form a single component.

The sleeve 5 therefore forms a kind of shielding corolla surrounding the nozzle 3 and makes it possible to keep the latter under a gaseous shielding atmosphere.

Provided in this sleeve 5 are one or more holes or orifices 18 which allow a dry shielding gas, for example dry air or nitrogen, to be introduced into the interior of the sleeve 5 so as to create a gaseous flush and/or a gaseous shielding atmosphere in the vicinity 15 of the nozzle 3 or of that part of the nozzle 3 which lies in the interior 15 of the shielding sleeve 5.

In this case, three orifices 18 have been arranged on the sleeve 5 so as to be equidistant from each other; however, this number of holes 18 and this arrangement of the holes on the sleeve 5 are in no way limiting.

The dry shielding gas is brought in from a storage or production site via conveying means 6, such as pipes, to the orifices 18 and so as to pass through the orifices 18 in the direction indicated by the arrow F'.

Preferably, connection means 17 allow the pipe 6 to be fastened to the sleeve 5 opposite the holes 18; sealing means 16, such as an O-ring seal, ensure that this connection is gastight, by preventing any parasitic ingress of moisture-laden atmospheric air into the connection.

Figure 2:
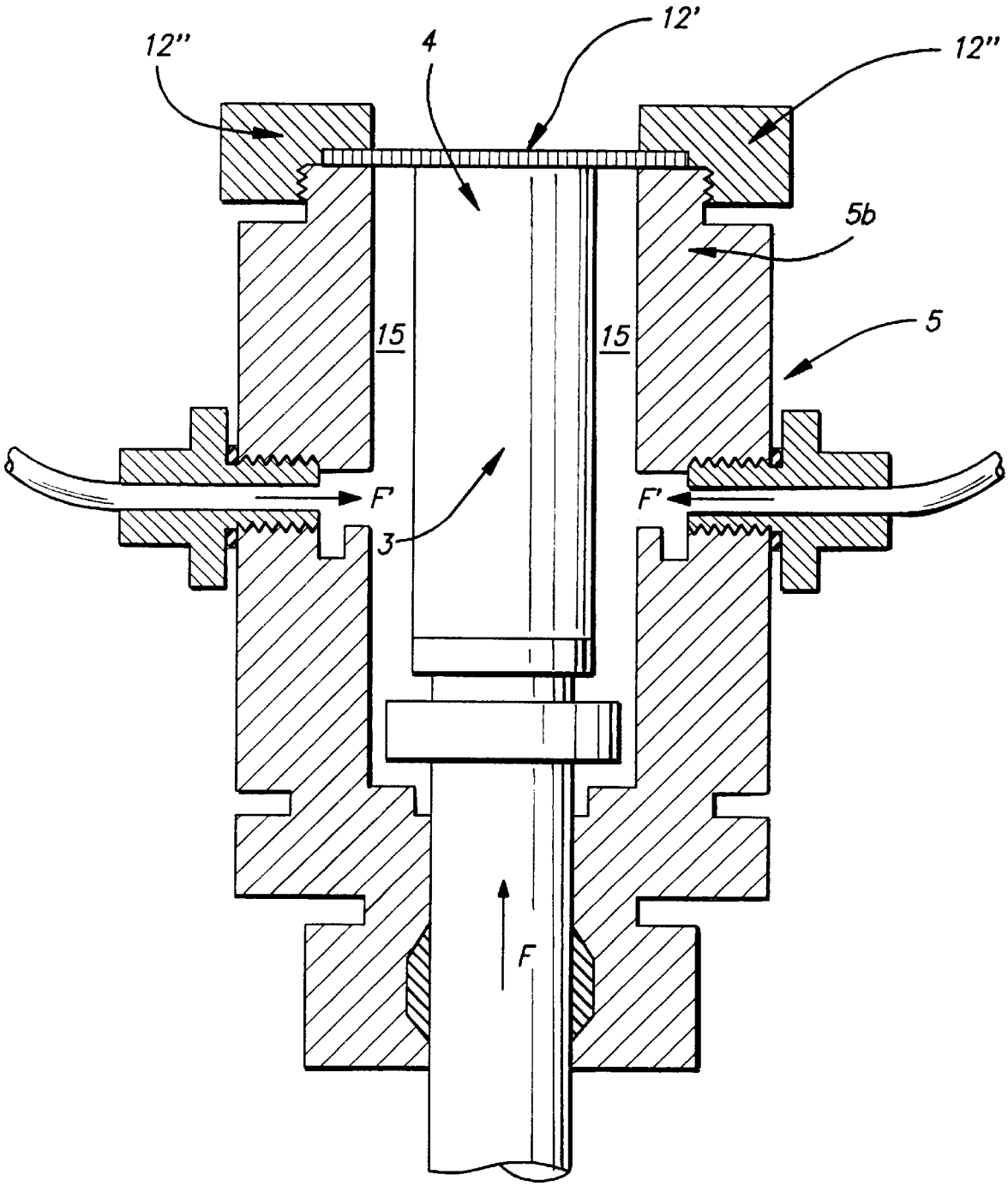
FIG. 2 depicts, diagrammatically, a longitudinal sectional view of a second embodiment of a device according to the invention.

FIG. 2 is similar to FIG. 1 and, consequently, the common, identical or similar parts will not be explained again below.

However, FIG. 2 includes two major differences compared with FIG. 1, namely, on the one and, that the nozzle 3 includes a downstream end 4 of flat or flattened cross-section whereas, in the case of FIG. 1, the downstream end 4 or outlet of the nozzle 3 had an approximately circular cross-section.

Moreover, the piece 12 depicted in FIG. 1 has been replaced by a plane piece 12' or plate 12', within which an orifice 13 (see FIG. 3 and FIG. 4) is provided, in which orifice the downstream end 4 of the nozzle 3 is housed. Such a plate 12' constitutes a mechanical barrier making it possible to limit the ingress of atmospheric air into the interior 15 of the sleeve 5. However, care must be taken to preserve at least one passage 14*a*, 14*b*, 14*c* and 14*d* intended to create a gaseous flushing stream around the end 4 of the nozzle 3 and/or to remove the excess dry shielding gas contained in the interior 15 of the sleeve 5.

This is because the gaseous flush produced by using the dry gas, for example dry air or nitrogen, around the end 4 of the nozzle 3 creates a stream of gas which is removed via the orifice or orifices 14*a*, 14*b*, 14*c* and 14*d* without disturbing the delivery of coolant, such as $CO_2$, via the nozzle 3 and prevents atmospheric air from entering the interior 15 of the sleeve 5 and from being deposited on the part 4 of the nozzle 3 and from causing icing thereon.

The plate 12' is, in this case, held in place on the end 5*b* of the sleeve 5 by screwing-type holding means 12".

Figure 3:
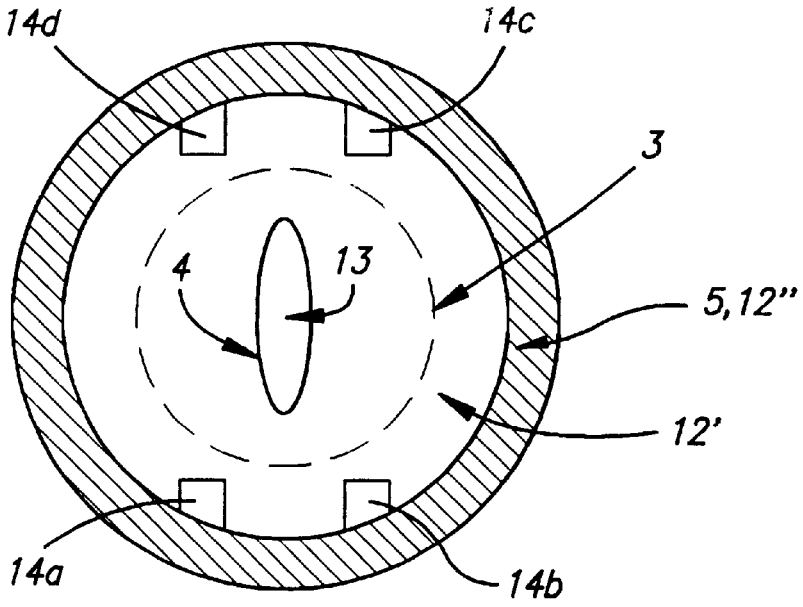
FIG. 3 depicts a top view of the device depicted in FIG. 2.
Figure 4:
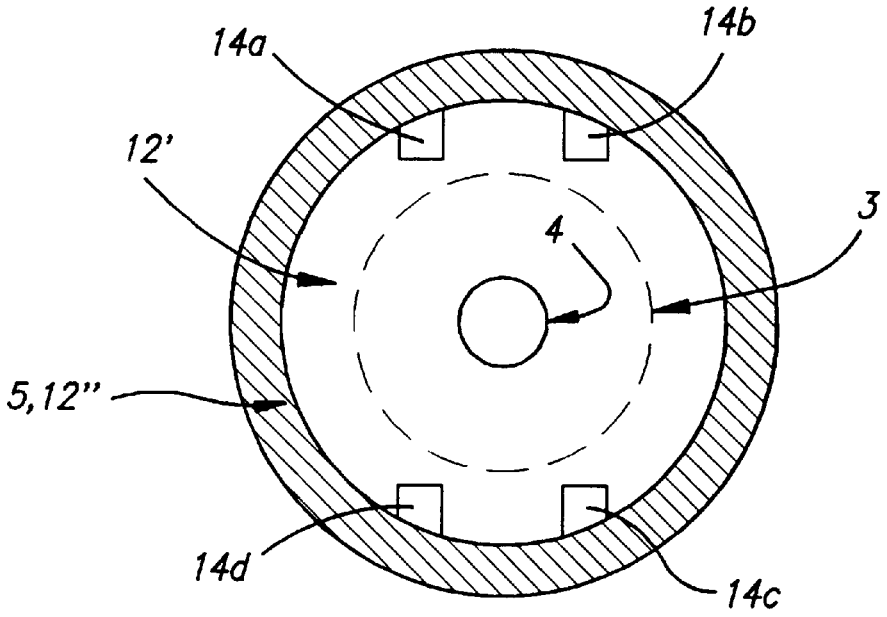
FIG. 4 is similar to FIG. 3 apart from the fact that the device depicted this time is provided with a nozzle having an approximately circular cross-section.
Figure 5:
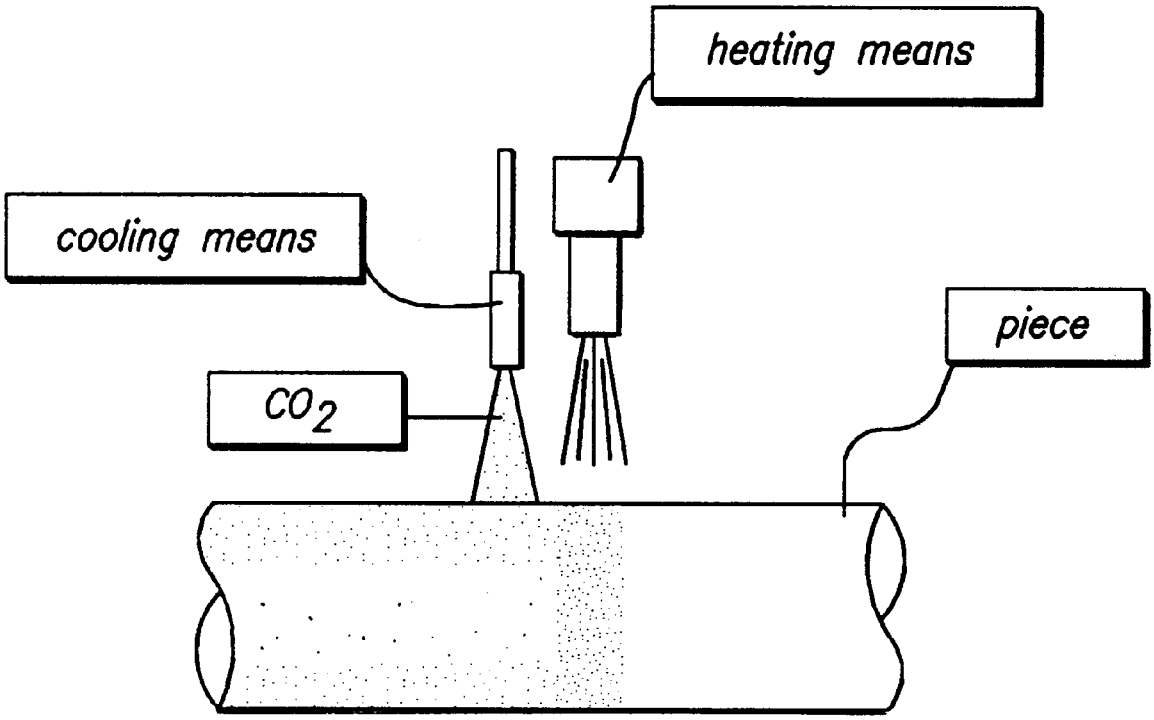
FIG. 5 PRIOR ART
FIG. 5 depicts a combination of heating means and cooling means according to the prior art.

FIG. 3 depicts a diagrammatic top view of the downstream end 4 of the nozzle 3 depicted in FIG. 2. More specifically, it shows the sleeve 5 surrounding the nozzle 3, the downstream end 4 of which has a flattened shape. The plate 12' is fastened by the holding means 12" to the sleeve 5 and/or to the end 4 of the nozzle 3 and includes a hole 13 into which the end 4 of the nozzle 3 is inserted. The dry shielding gas contained inside the sleeve 5 is removed via the orifices 14*a*, 14*b*, 14*c* and 14*d*, thus preventing the atmospheric air from entering the interior of the sleeve 5.

It goes without saying that the arrangement depicted in FIG. 1, in particular the piece 12, is not limited to nozzles having an approximately circular cross-section and that it can also be adapted to nozzles having a flat cross-section, such as that depicted in FIG. 2. Likewise, the arrangement consisting of the plate 12" of FIG. 2 is not limited to nozzles having a flat cross-section but can be adapted to nozzles having a circular cross-section, such as the one depicted in FIG. 1, by means of adaptations within the scope of those skilled in the art. Moreover, this may be clearly seen in FIG. 4, which in every way is similar to FIG. 3, apart from the fact that the nozzle depicted has, this time, not a flat cross-section but an approximately circular cross-section 4, like that of the nozzle 3 depicted in FIG. 1.

Both nozzle types, namely nozzles having an end of circular shape and those having a flattened end, make it possible to obtain jets of liquid coolant having different shapes and therefore serving for different applications.

In order to check the effectiveness of the device of the invention for the two embodiments depicted respectively in FIGS. 1 and 2, experimental tests were carried out and are recorded in the examples below.

EXAMPLE 1

A heat-treatment device provided with a cooling nozzle forming a round jet (circular end) and delivering a $CO_2$-type coolant was employed.

The nozzle is equipped at its downstream end with a shielding sleeve into which a shielding gas is introduced so as to create a flush around the downstream part of the carbon dioxide spray nozzle.

In this example, the shielding gas used is industrial compressed air, which is prefiltered in order to remove mainly the moisture, but also any grease arising from the compression.

During the period of operation of the nozzle, i.e. for 5 to 10 minutes, the nozzle is flushed by means of the compressed and filtered dry air.

This device is entirely satisfactory at the start, that is to say that during the first 5 to 10 minutes no icing of the downstream end of the nozzle is observed. However, after this time, a slight condensation appears on the downstream end of the nozzle because of moisture saturation of the filter used for purifying the compressed air serving as the shielding gas.

In other words, the slight condensation, or icing, observed is due not to the device of the present invention but to the inability of the filter employed to fulfil its role fully.

EXAMPLE 2

This Example 2 is in every way similar to Example 1, apart from the fact that in this case the shielding gas used is not compressed dry air but gaseous nitrogen which, on the one hand, is easier to handle and, on the other hand, does not require filtering.

Two different grades of nitrogen were used, namely N45 nitrogen and standard N25 nitrogen. N45 nitrogen has a maximum water content and a maximum oxygen content of about 5 ppm (parts per million by volume) while standard N25 nitrogen has a maximum water content of about 40 ppm and its oxygen content can vary.

In this Example 2, when using the equipment, no icing was observed on the $CO_2$ delivery nozzle.

Consequently, standard N25 nitrogen or N45 nitrogen can be used effectively for the purpose of forming a shielding gas for preventing icing of the nozzles delivering a coolant, such as $CO_2$, used in heat-treatment processes.

Moreover, this Example 2 confirms that the slight condensation which appeared on the nozzle in Example 1 is indeed the result of saturation of the filter with moisture.

In the above Examples 1 and 2, the shielding gas is delivered at a flow rate of about 15 l/min and at a pressure of approximately $1.2\times10^5$ Pa.

We claim:

1. In a process for the heat treatment of a material, which comprises:

spraying at least part of a surface of the material with at least one jet containing at least one hot carrier gas to obtain a heat-treated material; and cooling at least part of the heat-treated material;

the improvement wherein the cooling is carried out by:

providing at least one delivery nozzle which delivers a coolant; said at least one delivery nozzle being at least partially surrounded by at least one sleeve having an open and free distal end; and maintaining at least part of the delivery nozzle under a gaseous shielding atmosphere by flushing said nozzle with at least one gaseous shielding stream, said gaseous shielding stream circulating between the delivery nozzle and the surrounding sleeve, thereby preventing the delivery nozzle from icing by ambient moisture entering the sleeve at said open and free distal end and depositing on said nozzle delivering coolant, while excess gaseous shielding stream contained in the sleeve is removed via said open and free distal end.

2. The process according to claim 1, wherein the spray jet includes particles of an at least partially molten material, or softened particles.

3. The process according to claim 1, wherein the spray jet includes particles of a material selected from the group consisting of metals, metal alloys, ceramics, plastics, silica and metal oxides.

4. The process according to claim 1, wherein the flushing is performed by means of at least one dry gas.

5. The process according to claim 4, wherein the dry gas is selected from the group consisting of dry air, nitrogen, helium, argon and mixtures thereof.

6. The process according to claim 1, wherein the spraying results in the surface of the material being coated.

7. In a device for the heat treatment of a material, comprising:

spraying means for delivering at least one jet containing at least one hot carrier gas onto the material to obtain a heat-treated material; and cooling means operatively associated with said spraying means for cooling the heat-treated material; the improvement wherein the cooling means comprise:

delivery means for delivering at least one coolant, said delivery means including at least one delivery nozzle; and shielding means including at least one sleeve having an open and free distal end and surrounding, at least partially, said at least one delivery nozzle, said shielding means being connected to means for supplying at least one gaseous shielding stream for maintaining a gaseous atmosphere around at least part of said delivery means, thereby preventing the delivery nozzle from icing by ambient moisture entering the sleeve at said open and free distal end and depositing on said nozzle delivering coolant, while excess gaseous shielding stream contained in the sleeve is removed via said open and free distal end.

8. The device according to claim 7, wherein the sleeve is fastened at a proximal end to the delivery means.

9. The device according to claim 8, wherein the sleeve is fastened upstream of the nozzle.

10. The device according to claim 7, wherein the open and free distal end has a restriction.

11. The device according to claim 7, wherein the open and free distal end is partially closed off by a closing-off means.

12. The device according to claim 7, wherein the sleeve includes at least one orifice for introducing the gaseous shielding stream.

* * * * *